US006155567A

United States Patent [19]

Keleher

[11] Patent Number: 6,155,567

[45] Date of Patent: Dec. 5, 2000

[54] METHOD OF PLAYING A GAME WITH A DECK OF CARDS

[76] Inventor: Kevin Keleher, 1502 Sandalwood Dr., Haysville, Kans. 67060

[21] Appl. No.: 08/974,524

[22] Filed: Nov. 19, 1997

[51] Int. Cl.[7] ..... A63K 1/00

[52] U.S. Cl. ..... 273/292; 273/138.1

[58] Field of Search ..... 273/292, 138.1

[56] References Cited

U.S. PATENT DOCUMENTS

| | | | |
|---|---|---|---|
| 1,514,823 | 11/1924 | Austin | 273/292 X |
| 1,684,813 | 9/1928 | Ward | 273/292 X |
| 1,825,673 | 10/1931 | Latimer | 273/292 X |
| 2,006,521 | 7/1935 | Stone | 273/292 |
| 2,200,195 | 5/1940 | Thorne | 273/292 X |
| 5,112,059 | 5/1992 | Mundle et al. | 273/292 |
| 5,125,667 | 6/1992 | Richards | 273/292 X |
| 5,451,062 | 9/1995 | Malone | 273/292 |

OTHER PUBLICATIONS

*Scarne's Encyclopedia of Games*, John Scarne, pp. 142–155, Dec. 1973.

*Primary Examiner*—Sebastiano Passaniti
*Assistant Examiner*—Vishu Mendiratta
*Attorney, Agent, or Firm*—Kenneth Jack; Davis & Jack, LLC

[57] ABSTRACT

A method of playing a game with a deck of cards, having a plurality of card suits, and a plurality of card values; the method including the steps of dealing the deck so that the cards are evenly distributed among a group of players, bidding tentative trick quotas, the player bidding the highest number of tricks being a bid winner, designating a trump suit, the bid winner making such designation; establishing final trick quotas, wherein each bid loser declares a number of tricks, and playing a plurality of tricks, determining a trick winner after each trick.

12 Claims, 4 Drawing Sheets

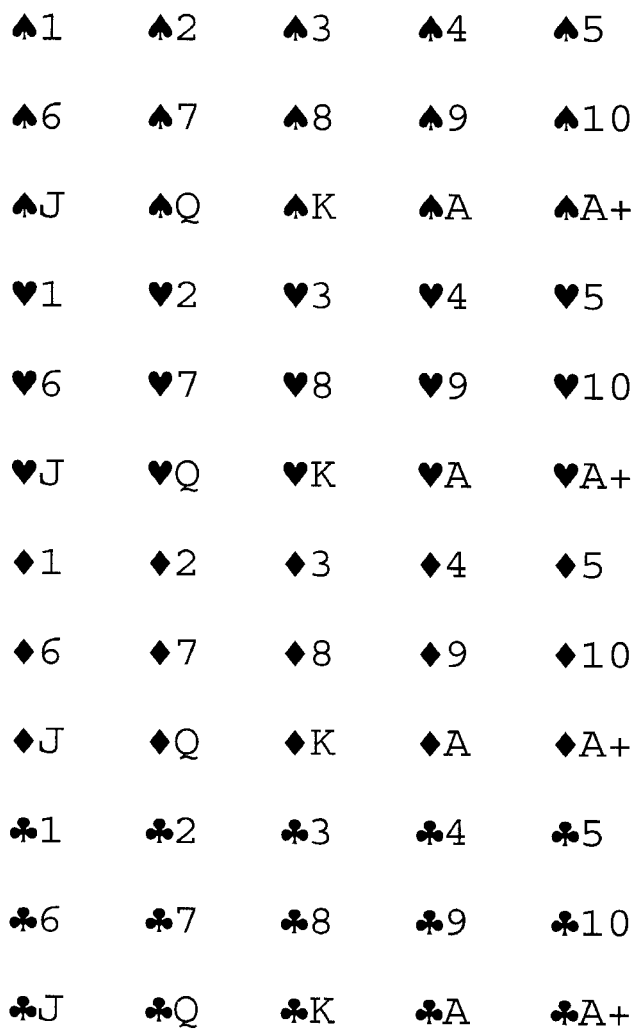

Fig. 1

| | | | | |
|---|---|---|---|---|
| ♠1 | ♠2 | ♠3 | ♠4 | ♠5 |
| ♠6 | ♠7 | ♠8 | ♠9 | ♠10 |
| ♠J | ♠Q | ♠K | ♠A | ♠A+ |
| ♥1 | ♥2 | ♥3 | ♥4 | ♥5 |
| ♥6 | ♥7 | ♥8 | ♥9 | ♥10 |
| ♥J | ♥Q | ♥K | ♥A | ♥A+ |
| ♦1 | ♦2 | ♦3 | ♦4 | ♦5 |
| ♦6 | ♦7 | ♦8 | ♦9 | ♦10 |
| ♦J | ♦Q | ♦K | ♦A | ♦A+ |
| ♣1 | ♣2 | ♣3 | ♣4 | ♣5 |
| ♣6 | ♣7 | ♣8 | ♣9 | ♣10 |
| ♣J | ♣Q | ♣K | ♣A | ♣A+ |

Fig. 2

Player B

♠A+ ♠A ♠K ♠10
♠9 ♠7 ♠6 ♠5
♥Q ♥J ♥10 ♥9 ♥8
♦4
♣3

Player A

♠3 ♠2
♥A+ ♥K ♥7 ♥6
♥5 ♥4 ♥3 ♥2
♦K ♦Q ♦J
♣4 ♣2

Player C

♠J ♠1
♥1
♦10 ♦9 ♦8 ♦7
♦6 ♦5 ♦1
♣J ♣9 ♣8 ♣7 ♣1

Player D

♠Q ♠8 ♠4
♥A
♦A+ ♦A ♦3 ♦2
♣A+ ♣A ♣K ♣Q
♣10 ♣6 ♣5

Fig. 3

Player B

♠A ♠1
♥K ♥Q ♥10
♦A+
♣A+ ♣A ♣Q ♣8
♣7 ♣5 ♣4 ♣3

Player A

♠K ♠7 ♠4 ♠3 ♠2
♥A+ ♥A
♦7 ♦5 ♦4 ♦1
♣J ♣9 ♣6 ♣1

Player C

♠A+ ♠9 ♠8 ♠6 ♠5
♥8 ♥6 ♥5 ♥4 ♥1
♦Q ♦9 ♦8 ♦6
♣10

Player D

♠Q ♠J ♠10
♥J ♥J ♥7 ♥3 ♥2
♦A ♦K ♦J
♦10 ♦2 ♦1
♣2

Fig. 4

Player B

| | | | |
|---|---|---|---|
| ♠10 | ♠9 | ♠7 | |
| ♠6 | ♠5 | ♠2 | |
| ♥A+ | ♥4 | ♥3 | ♥1 |
| ♦7 | ♦3 | ♦1 | |
| ♣Q | ♣1 | | |

Player A

| | | |
|---|---|---|
| ♠A+ | ♠A | ♠K |
| ♥K | ♥Q | ♥J |
| ♥10 | ♥9 | ♥8 |
| ♦A+ | ♦K | ♦Q |
| ♣A+ | ♣K | ♣J |

Player C

| | | | | |
|---|---|---|---|---|
| ♠Q | ♠J | | | |
| ♥A | ♥7 | ♥6 | ♥5 | ♥2 |
| ♦8 | ♦6 | ♦5 | ♦4 | ♦2 |
| ♣A | ♣10 | ♣9 | | |

Player D

| | | | |
|---|---|---|---|
| ♠8 | ♠4 | ♠3 | ♠1 |
| ♦A | ♦J | ♦10 | ♦9 |
| ♣8 | ♣7 | ♣6 | ♣5 |
| ♣4 | ♣3 | ♣2 | |

METHOD OF PLAYING A GAME WITH A DECK OF CARDS

FIELD OF THE INVENTION

This invention relates to card decks and methods of playing card decks.

BACKGROUND OF THE INVENTION

The game of Bridge utilizes a four suit fifty-two card deck and is played by four persons in paired partnerships. The game of Bridge is restrictive because four persons and only four persons may play; so long as no "dummy" hand is utilized. The game of Bridge also has an undesirably high level of complexity requiring, among other complicating factors, a high bidding player to play twenty-six cards.

In contrast to Bridge, games such as the game of Spades may be undesirably simple, having a pre-established trump suit. As in Bridge, the game of Spades lacks flexibility in grouping of players, typically requiring paired play among four players.

The instant inventive card deck and method of play solves such deficiencies of games such as Bridge and Spades, by eliminating partnerships among players, by providing for flexibility in the number of players which may play, by providing dual bidding rounds, and providing incentives for bidding accuracy. Flexibility in the number of players is a result of utilization of a sixty card deck. In the first round of bidding all players bid as though they would be allowed to declare the trump suit; and in the second round of bidding, players adjust their bids based upon the declared trump suit, if any. Bidding accuracy in the first bidding round is promoted because only the first player making the high bid is allowed to declare a trump suit. Bidding accuracy is promoted in the second round because points are docked both for taking a number of tricks greater than and less than a player's bid.

PRIOR ART PATENTS

U.S. Pat. No. 5,112,059 issued May 12, 1992, to Mundle, et al., discloses a card game.

U.S. Pat. No. 5,374,845 issued Dec. 27, 1994, to Cooter, et al., discloses a Bridge-type card game.

U.S. Pat. No. 4,009,884 issued Mar. 1, 1977, to Weigl discloses a Bridge game.

U.S. Pat. No. 4,248,434 issued Feb. 3, 1981, to Weigl discloses a Bridge game for 2 or 3.

U.S. Pat. No. 4,480,840 issued Nov. 6, 1984, to Cheng discloses a multi-suit card game.

U.S. Pat. No. 2,687,306 issued Aug. 24, 1954, to Cheng discloses a deck of playing cards.

None of the above disclosed patents teach, describe, or disclose the novel inventive and unique aspects and features of the present inventive playing card deck and method of play.

BRIEF SUMMARY OF THE INVENTION

The present inventive deck of playing cards comprises sixty cards divided evenly among four suits, preferably spades, hearts, diamonds and clubs, denoted by the symbols "♠", "♥", "♦", and "♣". Other card suit symbols may be suitably used. As in a conventional deck of fifty-two playing cards, each card suit preferably has numbered cards two through ten, a jack, a queen, a king, and an ace. Also, preferably, in addition to such cards, each suit has a card having a value lower than the two, preferably a "1" card; and each suit has a card having a value higher than the ace. Any consistently recognizable and unique symbol may be utilized to designate such high card. The sixty card playing deck is advantageous because sixty is evenly divisible by two, three, four, five, six, or ten, allowing players grouped in such numbers to play the deck. Preferably, groups of three, four, five, or six players play the sixty card deck.

In playing the inventive deck described above by a group of, for example, four players, the four players are seated at a card table, and the sixty card deck is shuffled. After the deck is shuffled, the four players preferably cut the deck for high card to determine the initial dealer. The initial dealer deals the deck in a clockwise fashion preferably starting with the player to his left. Each player is dealt a hand of fifteen cards, the cards being dealt face down. After all players have received their hand, a first bidding round commences.

In the first bidding round, each player organizes and evaluates his hand keeping the faces of his cards out of view of the other players. The first player to the left of the dealer then either bids a number of tricks he believes his hand may take or passes. The second player to the left of the dealer then either makes a bid higher than that of the first player to the left of the dealer or passes. The third player to the left of the dealer then either makes a bid higher than that of the second player to the left of the dealer or passes. The dealer then either makes a bid higher than that of the third player to his left or passes. After at least one trick has been bade, the bidding process continues clockwise around the table until there are three consecutive passes. In evaluating his hand for bidding its trick taking power, each player assumes that he will be allowed to declare the trump suit. Typically, bidding in the first bidding round will end no later than the second bid of the third player to the left of the dealer. Bidding accuracy in the first round is encouraged because any player who has a prospect of becoming the bid winner and who forbears from bidding in the first instance the full strength of his hand, may allow a subsequently bidding player having a hand of equal strength to declare trump suit. The high bidder's bid in the first bidding round becomes his final trick quota; further encouraging bidding accuracy.

After completion of the first bidding round, the high bidder either declares no-trump or declares a trump suit. The other players then, in clockwise sequence beginning at the left of the high bidder, adjust their bids based upon the trump suit, if any. The trump suit, or no-trump, is noted on a tally sheet, along with each player's adjusted bid. Play then commences in a series of fifteen tricks. Where six players play, ten tricks are played from each hand. Where five players play, twelve tricks are played from each hand. Where three players play, twenty tricks are played from each hand.

The player to the left of the first round high bidder selects and leads a first card from his hand. Play continues in a clockwise fashion with each other player throwing a card upon the table from his hand. Where a non-trump suit card is led, the card thrown by each other player must follow suit so long as a matching suit card is held. Where a player's hand does not contain a card matching the suit of the card led, the player may either slough an out of suit card, or play a trump suit card. The player playing the highest valued trump suit card in the trick is the winner of the trick. Where no player plays a trump suit card in the trick, the player playing the highest valued card matching the suit of the lead card is the winner of the trick.

The trick winner of the first trick plays the lead card in the second trick; wherein the cards are played in the same fashion as the first trick. Tricks continue to be played with the winner of the prior trick playing the lead card in the next succeeding trick until all sixty cards dealt the four players have been played.

After all cards have been played, the number of tricks taken by each player is compared with each player's bid. Preferably, a player who takes a number of tricks equaling his bid receives a number of points being a multiple of his bid. Also preferably, players who take fewer tricks than the number bade, or take excess tricks, are docked points. Thus, accuracy in bidding is rewarded, while overbidding and underbidding is discouraged. Preferably players whose tricks match their bid are awarded ten times their bid. Preferably players whose tricks taken are less than their bid are docked points equal to ten times their bid. Preferably players who take tricks in excess of their bid are first awarded a number of points equal to ten times their bid, and are then docked ten times the number of overtricks. Players who bade zero, bidding "nil", and took no tricks preferably are awarded thirty points, while players who bade "nil" and took one or more tricks are preferably docked thirty points.

Preferably, the card game is played in a series of twenty to twenty-six hands, with each player's points awarded or docked noted on the player tallies making up a cumulative total number of points. The player having the highest number of points at the end of the last hand played is declared the winner.

Like computerized bridge games and other common computerized card games, the present inventive card game is amenable to computerization wherein the deck of cards is generated and randomly dealt by a computer and wherein one or more of the players is a computer generated player.

Accordingly, it is an object of the present inventive card deck and card game to provide a card deck having sixty cards which are evenly divisible among variously sized groups of players.

It is a further object to provide such a card deck and card game further providing for a dual round of bidding.

It is a further object to provide such a card deck and card game further providing for a bidding structure which promotes accuracy in bidding.

It is a further object to provide such a card deck and card game further promoting accuracy in bidding through awarding and docking of points for undertricks and overtricks.

Other and further objects, benefits, and advantages will become known to those skilled in the art upon review of the Brief Description and Detailed Description which follows, and upon review of the appended drawings.

BRIEF DESCRIPTION OF THE DRAWINGS

FIG. 1 is a symbolic representation of the face of each of the sixty cards of the present inventive card deck.

FIG. 2 is a symbolic representation of four exemplary hands dealt from the inventive sixty card deck.

FIG. 3 is a symbolic representation of four exemplary hands redealt from the inventive sixty card deck.

FIG. 4 is a symbolic representation of four exemplary hands redealt from the inventive sixty card deck.

DETAILED DESCRIPTION

Referring now to the drawings, and in particular to FIG. 1, the faces of the sixty cards of the present inventive card deck are symbolically represented. The deck comprises four suits; i.e., spades, hearts, diamonds, and clubs, each suit having fifteen cards. Within each fifteen card suit is a hierarchy of card values, the one cards having the lowest value and the A+ cards having the highest values. Since spades, hearts, diamonds, and clubs are suit indicia familiar to card players in general, such suit indicia are preferably used in the present inventive card deck and card game. Also, since the card value hierarchy of two, three, four, five, six, seven, eight, nine, ten, jack, queen, king, ace is well known to card players, such card value indicia are also preferably utilized. Utilization of traditional suit indicia and card value indicia is not essential to the deck or to the game; and any distinctly recognizable indicia of card suit and card value may be utilized.

The sixty card deck represented in FIG. 1 is particularly advantageous because sixty is evenly divisible by two, three, four, five, six, and ten, allowing the deck to be evenly dealt among several differently sized groups of card players. Preferably, the present inventive card game is played by three, four, or five players.

At the commencement of the present inventive card game, played by, for example, a group of four players, the deck of cards is shuffled and the cards are dealt by one of the players who is designated as a dealer. The dealer evenly distributes the cards among the four players. FIG. 2 represents exemplary hands held by four players, designated as Player A, Player B, Player C, and Player D. All such players upon receiving their hand of cards organize them and hold them so that no other player may see the faces of the cards of his hand.

After the cards are dealt, each player evaluates the strength of his hand assuming that he will be allowed to declare the trump suit or declare no-trump. A first round of bidding then commences. Typically, the player to the left of the dealer will make the initial bid in the first round of bidding and, referring to FIG. 2, assuming that Player D dealt the cards, Player A would be the first to bid. In evaluating his hand, Player A likely would bid as though he would be permitted to declare hearts as the trump suit. Since Player A has eight hearts and three high diamonds, he may logically make a first round bid of seven. Player B, in evaluating his hand, would assume an ability to declare spades as the trump suit. The strength of Player B's eight spades and five hearts would allow Player B to bid ten. The next player to bid, Player C, would readily see, based on the strength of his hand, that he has no hope of taking ten, so he would pass. Next in turn, Player D would make the same conclusion and pass. Player A, having initially bade his best estimate of the strength of his hand, would also pass. Upon three consecutive passes after a bid, the bidding in the first round is closed and Player B would be declared the high bidder.

After closure of the first round of bidding, a second bidding round takes place in which the players other than the bid winner in the first round adjust their bids, taking into account the suit declared as trump, or, as the case may be, taking into account a declaration of no-trump. Preferably, the player to the left of the bid winner in the first round makes the first bid in the second round. For example, referring to FIG. 2, with spades as trumps, Player C may bid zero or "nil", Player D may bid three, and Player A may bid two. Player B would not bid in the second round of bidding because his high bid of ten in the first round becomes his final bid in the second round. After closure of the second round of bidding, the trump suit and each player's final bid are noted upon a player tally sheet; and play commences.

Preferably, referring to FIG. 2, Player C, i.e., the player to the left of the first round bid winner, commences play by selecting and playing a lead card; such player laying one of his cards upon the table, face up, for viewing by the other players. Players D, A, and B then, in turn, select and play a card from their hands, the four cards played comprising a trick. In the trick, each player must play a card following the suit of the lead card except where no such card is held. Where a player is not able to follow suit, the player may "slough" an out of suit card, or the player may play a trump suit card. In a trick, the player who plays the highest valued trump suit card is the trick winner. Where no player plays a trump suit card, the player who plays the highest valued card following the suit of the lead card is the trick winner.

Referring to FIG. 2, the players continue to play cards from their hands in a series of fifteen tricks. In each trick other than the first, the player playing the lead card is the trick winner of the immediately preceding trick. After all sixty cards have been played in the fifteen tricks, the number of tricks taken by each player are tallied and compared to the number of tricks bade by each player. Preferably, each player who takes a number of tricks matching his bid is awarded points equaling ten times his bid. For example, referring to FIG. 2, if Player B were to take ten tricks, matching his bid of ten, he would receive a score of one hundred. Also preferably, players who take a number of tricks less than the number bade are docked a number of points equal to ten times their bid. For example, referring to FIG. 2, if Player A were to take six tricks, having bade seven, Player A would docked seventy points. Also preferably, players who take a number of tricks in excess of their bid are first awarded points ten times their bid and then docked ten times the number of their overtricks. For example, referring to FIG. 2, were Player B to take eleven tricks, having bade ten, he would be awarded ninety points; i.e., one hundred points less ten points; having taken one overtrick, Player B is penalized. Where a player bids zero or "nil" and successfully avoids taking any tricks, such player preferably is awarded thirty points. Where a player bidding "nil" is forced to take a trick, such player preferably is docked thirty points. Points awarded and docked after completion of play of each hand are preferably noted on the player tallies.

Referring to FIG. 3, for exemplary hands resulting from a second dealing of the sixty card deck are symbolic represented. Preferably, the player to the left of the dealer of the last hand is the dealer of a current hand. Assuming that Player D dealt the hand depicted in FIG. 2, Player A would be the dealer of the hand depicted in FIG. 3. After dealing the deck, Player B, he being to the left of Player A, would initiate the bidding in the first bidding round. Referring to FIG. 3, assuming that clubs were declared a trump suit, Player B would have a very strong hand and possibly could bid as high as eleven. The other players would thereafter pass, causing Player B to be declared the bid winner. Thereafter, in the second bidding round both Players C and D could bid zero or "nil" and Player A could logically bid three. Thereafter, referring to FIG. 3, play would progress in the same manner as described with respect to the hand depicted in FIG. 2.

A subsequently dealt hand is depicted in FIG. 4, with Player B dealing and with Player C making the initial bid in the first bidding round. In a first bidding round where a player has little hope of becoming the high bidder, such bidder may logically pass rather than bid, thus avoiding giving other players clues as to his hand strength. According to the hand strengths shown in FIG. 4, Players C, D, and A may, in sequence, logically pass. Thereafter, Player B may logically bid ten or eleven, assuming that he would declare no-trump. Thereafter, Players C, D, and A would again pass, and Player B would be declared the bid winner. Thereafter, in the second bidding round, with no-trump declared, Player C may logically bid two, Player D may logically bid one, and Player B may logically bid one. Play then commence in the same manner as described with respect to the hands depicted in FIG. 2.

Preferably, a series of twenty to twenty-six hands are played, with the total score of each player being tabulated at the end. The player having the high score after the last hand played is declared the game winner.

While the principles of the invention have been made clear in the above illustrative and explanatory text and drawings, those skilled in the art may make modifications in the modes of play and deck configurations of the invention without departing from those principles. Accordingly, it is intended that the description and drawings be interpreted as illustrative and not in the limiting sense, and that the invention be given a scope commensurate with the appended claims.

I claim:

1. A method of playing a game with a deck of cards, the deck of cards comprising media selected from the group of tangible cards or intangible computer generated cards, the deck of cards having a plurality of card suits, and the deck of cards having a plurality of card values; the method comprising the steps of:

(a) dealing the deck to a plurality of players so that the cards are evenly distributed among the players, the players being selected from the group of human beings, computer generated players, or a combination of human beings and computer generated players;

(b) bidding tentative trick quotas, wherein at least one player bids a number of tricks greater than zero, the player bidding the highest number of tricks being a bid winner, all other players being bid losers, such highest number of tricks being a final trick quota applicable to the bid winner;

(c) designation at most one card suit as a trump suit, the bid winner making such designation;

(d) establishing bid loser final trick quotas, wherein each bid loser declares a number of tricks, such numbers of tricks being final trick quotas applicable to the bid losers;

(e) playing a trick, wherein each player selects and plays a card; and, (f) determining a trick winner, the trick winner being the player who played in the trick the highest valued trump suit card, or, where no player played a trump suit card, the trick winner being the player who played the highest valued lead suit card, the lead suit being the suit of the first card played in the trick.

2. The method of claim 1, further comprising the step of repetition of the playing a trick step and the determining a trick winner step, such repetition continuing until all cards have been played.

3. The method of claim 2, further comprising the step of establishing player trick tallies, the player trick tallies being totals of the number of times each player is determined a trick winner.

4. The method of claim 3, further comprising the step of awarding points to each player whose player trick tally is at least as great as his final trick quota.

5. The method of claim 4, further comprising the step of docking points from each player whose player trick tally differs from his final trick quota.

6. The method of claim 5, further comprising the steps of:

(a) Repetition of the dealing the deck step, the bidding tentative trick quotas step, the designating trump suit step, the establishing final trick quotas step, the playing a trick steps, the determining a trick winner steps, the establishing player trick tallies step, the awarding points step, and the docking points step;

(b) Determining player point totals, the player point totals being sums of points awarded to the players less sums of points docked from the players; and, (c) Determining a game winner, the game winner being the player having the highest player point total.

7. A method of playing a game with a deck of sixty cards, the deck of sixty cards comprising media selected from the group of tangible cards or intangible computer generated cards, the deck of cards having four card suits, and the deck of cards having fifteen card values; the method comprising the steps of:

(a) dealing the deck of cards to a group of players, the number of players among the group being a number by which sixty is evenly divisible, the cards being evenly distributed among the players, the players being selected from the group of human beings, computer generated players, or a combination of human beings and computer generated players;

(b) bidding tentative trick quotas, wherein at least one player bids a number of tricks greater than zero, the player bidding the highest number of tricks being a bid winner, all other players being bid losers, such highest number of tricks being a final trick quota applicable to the bid winner;

(c) designating at most one of the four card suits as a trump suit; the bid winner making such designation;

(d) establishing bid loser final trick quotas, wherein each bid loser declares a number of tricks, such numbers being final trick quotas applicable to the bid losers;

(e) playing a trick wherein a lead player chosen from the group of players plays a lead card, wherein all other players who hold a card of the same suit as the lead card play such a card, and wherein all other players who do not hold a card of the same suit as the lead card either play a trump suit card or slough a card, the lead player being the first player to play a card in the trick, the lead card being the card first played in the trick, and sloughing a card being playing a card of a suit which is neither of the same suit as the suit of the lead card, nor the trump suit; and, (f) determining a trick winner, the trick winner being the player who played in the trick the highest valued trump suit card, or, where no player played in the trick a trump suit card, the trick winner being the player who played the highest valued card of the same suit as the lead card.

8. The method of claim 7, further comprising the step of repetition of the playing a trick step and the determining a trick winner step, such repetition continuing until all sixty cards have been played.

9. The method of claim 8, further comprising the step of establishing player trick tallies, the player trick tallies being totals of numbers of times each player is determined a trick winner.

10. The method of claim 9, further comprising the step of awarding points to each player whose player trick tally is at least as great as his final trick quota.

11. The method of claim 10, further comprising the step of docking points from each player whose player trick tally differs from his final trick quota.

12. The method of claim 11, further comprising the steps of:

(a) Repetition of the dealing the deck step, the bidding tentative trick quotas step, the designating trump suit step, the establishing final trick quotas step, the playing a trick steps, the determining a trick winner steps, the establishing player trick tallies step, the awarding points step, and the docking points step;

(b) Determining player point totals, the player point totals being sums of points awarded to the players, less sums of points docked from the players; and, (c) Determining a game winner, the game winner being the player having the highest player point total.

* * * * *